US009732641B2

(12) United States Patent
Sugiura et al.

(10) Patent No.: US 9,732,641 B2
(45) Date of Patent: Aug. 15, 2017

(54) VARIABLE VALVE MECHANISM OF INTERNAL COMBUSTION ENGINE

(71) Applicant: OTICS CORPORATION, Nishio-shi (JP)

(72) Inventors: Masatoshi Sugiura, Nishio (JP); Koki Yamaguchi, Nishio (JP); Naoki Hiramatsu, Nishio (JP)

(73) Assignee: OTICS CORPORATION, Nishio-Shi, Aichi-Ken (JP)

( * ) Notice: Subject to any disclaimer, the term of this patent is extended or adjusted under 35 U.S.C. 154(b) by 22 days.

(21) Appl. No.: 14/856,366

(22) Filed: Sep. 16, 2015

(65) Prior Publication Data

US 2016/0108780 A1 Apr. 21, 2016

(30) Foreign Application Priority Data

Oct. 21, 2014 (JP) ..... 2014-214286

(51) Int. Cl.
*F01L 1/18* (2006.01)
*F01L 13/00* (2006.01)
*F01L 1/24* (2006.01)

(52) U.S. Cl.
CPC ..... *F01L 13/0021* (2013.01); *F01L 1/18* (2013.01); *F01L 1/185* (2013.01); (Continued)

(58) Field of Classification Search
CPC ..... F01L 13/0021; F01L 1/18; F01L 13/0005; F01L 2001/186; F01L 1/185
See application file for complete search history.

(56) References Cited

U.S. PATENT DOCUMENTS 6,412,460 B1 * 7/2002 Sato ..... F01L 1/053 123/90.16
2003/0200947 A1 10/2003 Harris
(Continued)

FOREIGN PATENT DOCUMENTS

DE 10 2004 027 054 A1 12/2005
JP S 63-105211 A 5/1988
(Continued)

OTHER PUBLICATIONS

Extended European Search Report dated Mar. 1, 2016.

*Primary Examiner* — Zelalem Eshete
(74) *Attorney, Agent, or Firm* — McGinn IP Law Group, PLLC.

(57) ABSTRACT

The present invention provides a variable valve mechanism of an internal combustion engine, which includes a rocker arm that includes a roller arm including a roller that rotatably abuts against a cam and a side arm provided at a side of the roller arm and that drives a valve, and a switching device that includes a switching pin and a hydraulic chamber provided inside the rocker arm and that switches a drive state of the valve by displacing the switching pin between a coupling position at which the switching pin extends between the roller arm and the side arm and a non-coupling position at which the switching pin does not extend between the roller arm and the side arm based on variations in hydraulic pressure in the hydraulic chamber. The switching pin is provided on an axis of the roller, and the hydraulic chamber is provided inside the roller arm.

17 Claims, 11 Drawing Sheets

(52) U.S. Cl.
CPC ..... *F01L 13/0005* (2013.01); *F01L 1/2405* (2013.01); *F01L 2001/186* (2013.01); *F01L 2105/02* (2013.01)

(56) References Cited

U.S. PATENT DOCUMENTS

| | | | | |
|---|---|---|---|---|
| 2004/0074459 | A1 | 4/2004 | Hayman et al. | |
| 2005/0247279 | A1 | 11/2005 | Rorig et al. | |
| 2006/0157011 | A1 | 7/2006 | Proschko et al. | |
| 2007/0028876 | A1* | 2/2007 | Fujita ..... | F01L 13/0005 123/90.16 |
| 2011/0265751 | A1 | 11/2011 | Becker et al. | |

FOREIGN PATENT DOCUMENTS

| | | | |
|---|---|---|---|
| JP | 2002-285811 | A | 10/2002 |
| JP | 2008-208746 | A | 9/2008 |

* cited by examiner

VARIABLE VALVE MECHANISM OF INTERNAL COMBUSTION ENGINE

TECHNICAL FIELD

The present invention relates to a variable valve mechanism that drives a valve of an internal combustion engine and that changes the drive state of the valve in accordance with the operating status of the internal combustion engine.

BACKGROUND ART

Variable valve mechanisms according to Patent Documents 1 to 5 are all configured as follows. That is, as in a variable valve mechanism 80 according to a first related art (Patent Document 1) illustrated in FIG. 10, for example, the variable valve mechanisms include a rocker arm 82 that drives a valve 7. The rocker arm 82 includes a roller arm 83 including a roller 83*a* that rotatably abuts against a cam 81, and a side arm 84 provided at a side of the roller arm 83.

The variable valve mechanisms further include switching pins 86 and 86 and a hydraulic chamber 87 provided inside the rocker arm 82. The variable valve mechanisms switch the drive state of the valve 7 by displacing the switching pins 86 between a coupling position at which the switching pins 86 extend between the roller arm 83 and the side arm 84 and a non-coupling position at which the switching pins 86 do not extend between the roller arm 83 and the side arm 84 based on variations in hydraulic pressure in the hydraulic chamber 87.

CITATION LIST

Patent Document

Patent Document 1: U.S. Patent Application Publication No. 2004/0074459

Patent Document 2: U.S. Patent Application Publication No. 2005/0247279

Patent Document 3: German Patent Application Publication No. 102004027054

Patent Document 4: U.S. Patent Application Publication No. 2006/0157011

Patent Document 5: U.S. Patent Application Publication No. 2003/0200947

Patent Document 6: Japanese Patent Application Publication No. 2008-208746

SUMMARY OF THE INVENTION

Technical Problem

In all the variable valve mechanisms according to Patent Documents 1 to 5, as in the variable valve mechanism 80 according to the first related art (Patent Document 1), the switching pins 86 and 86 are provided near the center of swing of the roller arm 83, and not provided near the roller 83*a* which is driven by the cam 81, which complicates relative displacement between the roller arm 83 and the side arm 84 at a non-coupled time. Therefore, the structure of the rocker arm 82 may be complicated.

Thus, the applicant developed a variable valve mechanism 90 according to a second related art (Patent Document 6) illustrated in FIG. 11. In the variable valve mechanism 90, a switching pin 96 is provided on the axis of a roller 93*a* driven by a cam, which simplifies relative displacement between a roller arm 93 and side arms 94 and 94 at a non-coupled time. Therefore, the structure of a rocker arm 92 is simplified.

However, the following issue is posed. That is, the presence of a hydraulic chamber 97 inside the side arm 94 may widen the side arm 94. Therefore, the rocker arm 92 may be widened as a whole. Therefore, although the configuration can be adopted in a two-valve integral formation in which two valves 7 and 7 are driven by one rocker arm 92, the configuration may not be adopted with ease in a single-valve formation in which only one valve is driven by one rocker arm. In the case where the configuration is adopted in the two-valve integral formation, it is preferable that the rocker arm be made compact in the width direction.

It is therefore an object to simplify the structure of a rocker arm by simplifying relative displacement between a roller arm and a side arm at a non-coupled time, and to make the rocker arm compact in the width direction.

Solution to Problem

In order to attain the object described above, the variable valve mechanism of an internal combustion engine according to the present invention is configured as follows. That is, a variable valve mechanism of an internal combustion engine, includes: a rocker arm that includes a roller arm including a roller that rotatably abuts against a cam and a side arm provided at a side of the roller arm, and that drives a valve; and a switching device that includes a switching pin and a hydraulic chamber provided inside the rocker arm, and that switches a drive state of the valve by displacing the switching pin between a coupling position at which the switching pin extends between the roller arm and the side arm and a non-coupling position at which the switching pin does not extend between the roller arm and the side arm based on variations in hydraulic pressure in the hydraulic chamber. In the variable valve mechanism, the switching pin is provided on an axis of the roller, and the hydraulic chamber is provided inside the roller arm.

The switching pin and the hydraulic chamber are not specifically limited, and examples of the switching pin and the hydraulic chamber include the following aspects a and b. The aspect b is preferable in that the rocker arm is made more compact.

[a] The switching pin supports the roller, and the hydraulic chamber is provided in a portion of the roller arm positioned at a side of the roller.

[b] The roller arm includes a roller shaft that supports the roller, and the switching pin and the hydraulic chamber are provided inside the roller shaft.

Advantageous Effects of Invention

According to the present invention, the switching pin is provided on the axis of the roller which is driven by the cam. Therefore, relative displacement between the roller arm and the side arm at the non-coupled time is simplified compared to a case where the switching pin is provided near the center of swing. Therefore, the structure of the rocker arm is simplified.

In addition, the hydraulic chamber is provided inside the roller arm which is wide because of the presence of the roller. Thus, the rocker arm is less likely to be wide compared to a case where the hydraulic chamber is provided inside the side arm. Therefore, the rocker arm can be made compact in the width direction.

DESCRIPTION OF EMBODIMENTS

Figure 1:
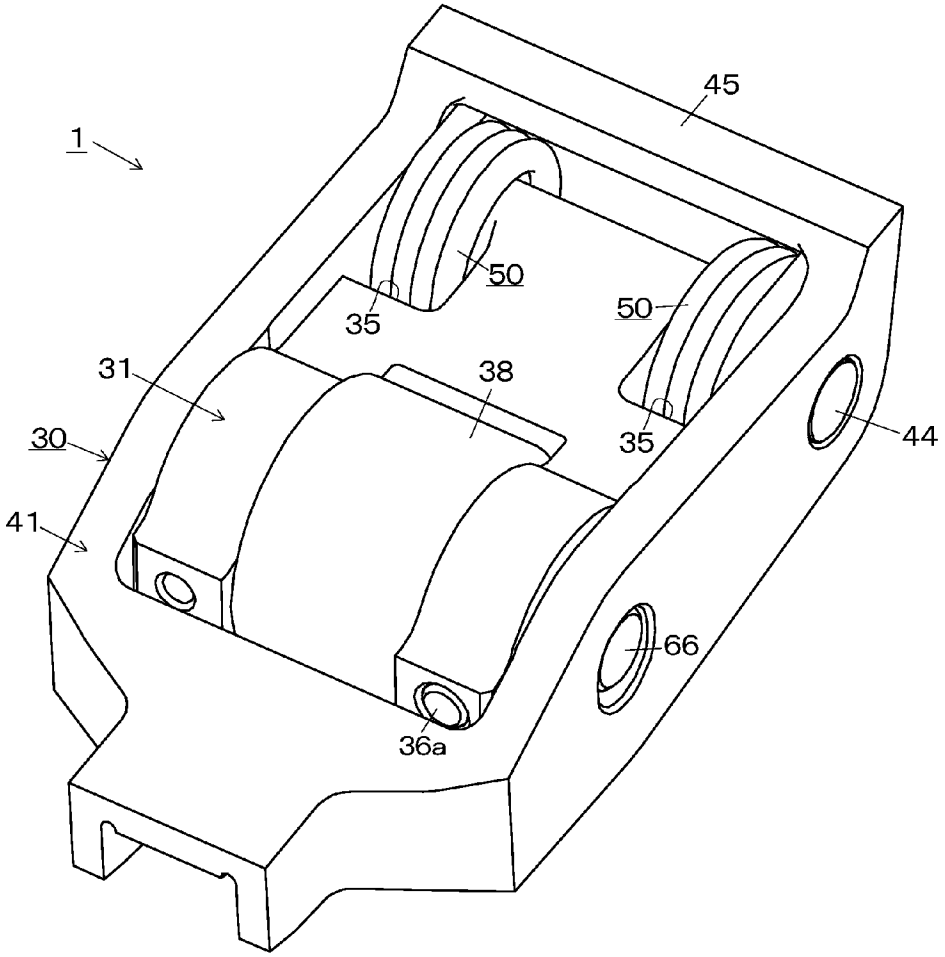
FIG. 1 is a perspective view illustrating a rocker arm of a variable valve mechanism according to a first embodiment.
Figure 2A:
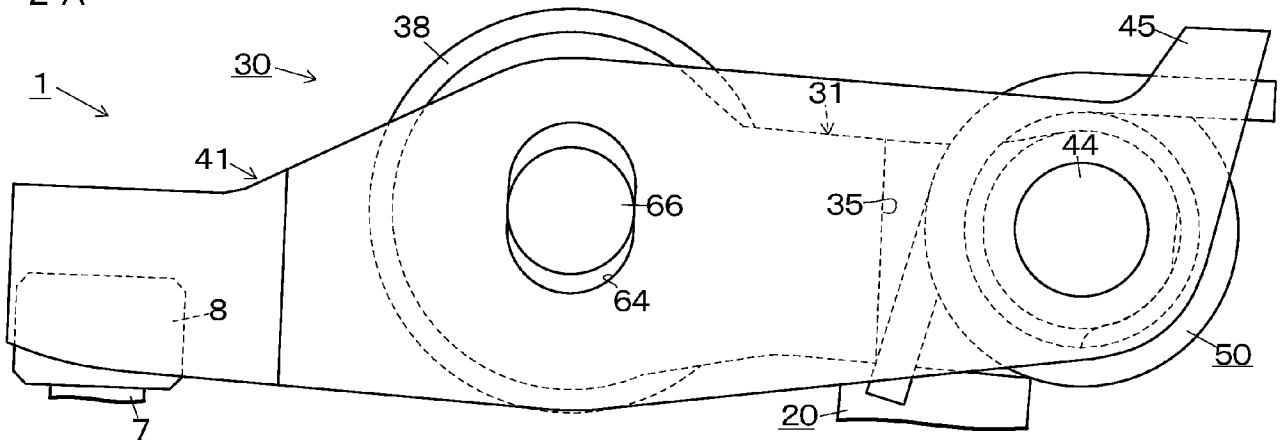
FIG. 2A is a side view.
Figure 2B:
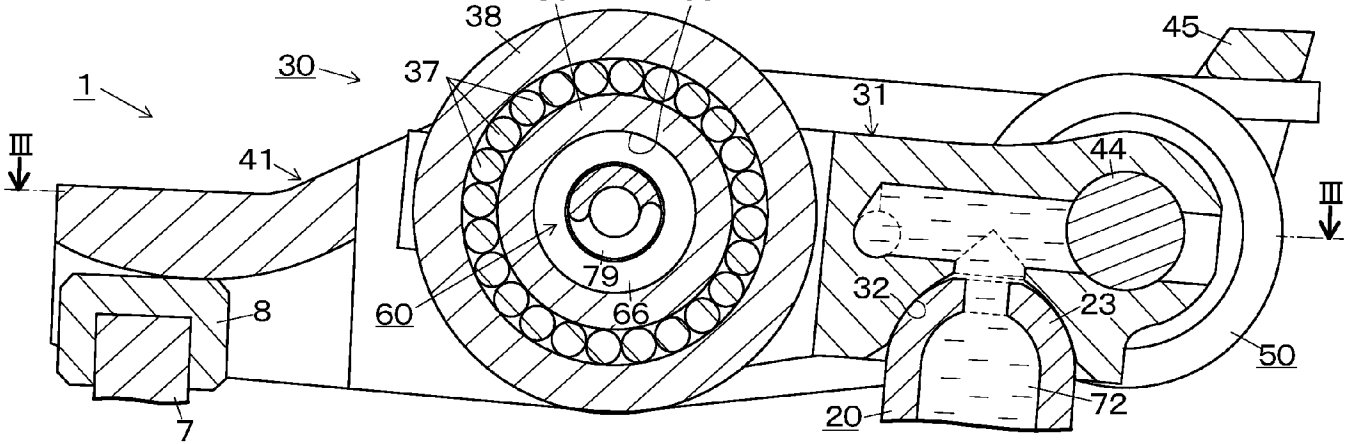
FIG. 2B is a side sectional view (a IIB-IIB sectional view illustrated in FIG. 3), respectively, illustrating the variable valve mechanism according to the first embodiment.
Figure 3:
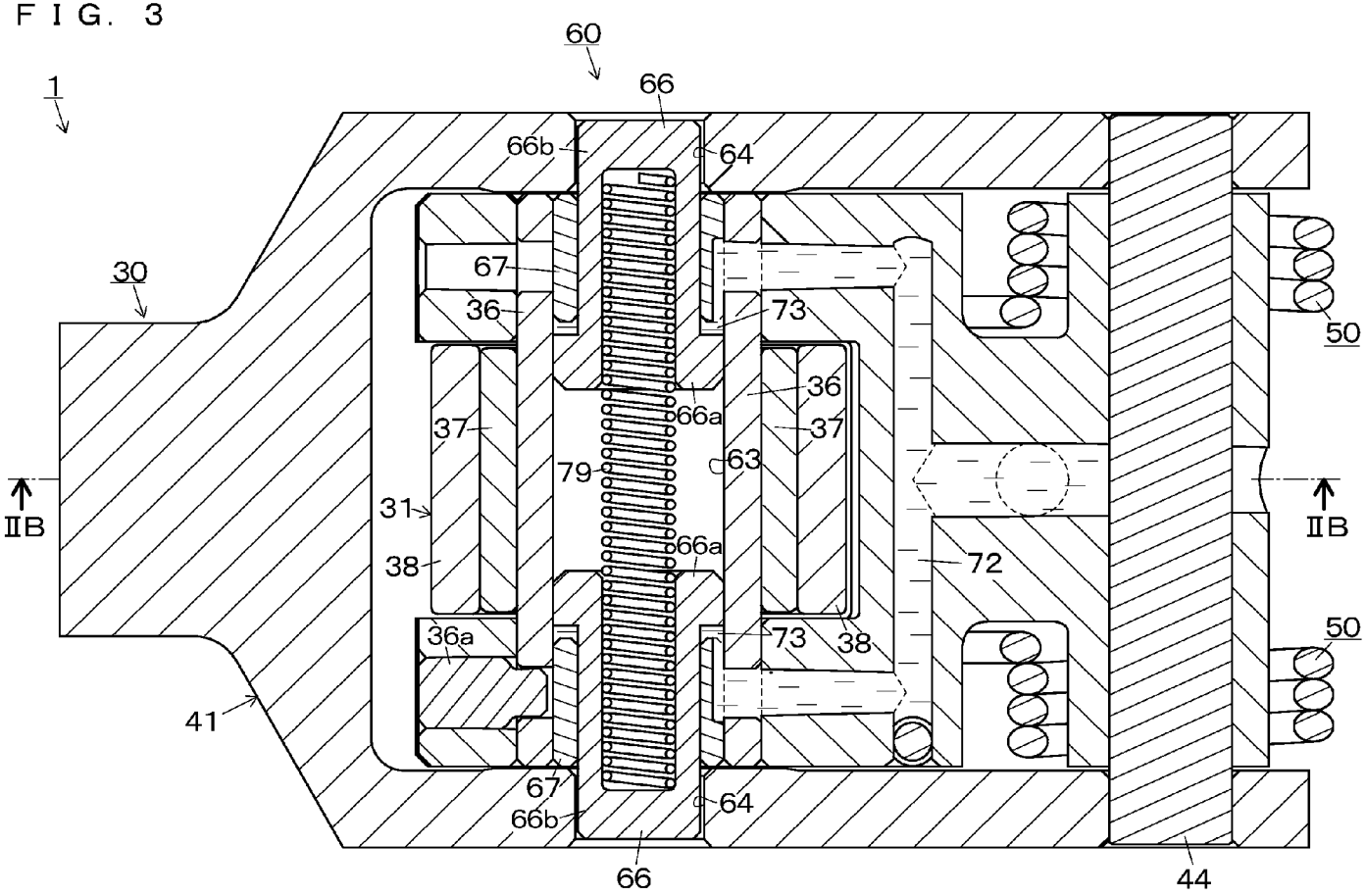
FIG. 3 is a plan sectional view (a III-III sectional view illustrated in FIG. 2B) illustrating the variable valve mechanism according to the first embodiment.

In the aspect b (with the switching pin and the hydraulic chamber provided inside the roller shaft), the roller shaft, the switching pin, and the hydraulic chamber are not specifically limited, and examples of the roller shaft, the switching pin, and the hydraulic chamber include the following aspect. That is, the roller shaft is a tubular shaft; the switching pin includes a large diameter portion and a small diameter portion arranged side by side in a longitudinal direction of the roller shaft, the large diameter portion is formed to have such a dimension that an outer peripheral surface of the large diameter portion is in sliding contact with an inner peripheral surface of the roller shaft without a gap therebetween, and the small diameter portion is formed to have such a dimension that there is a gap between an outer peripheral surface of the small diameter portion and the inner peripheral surface of the roller shaft; a tubular guide member is attached inside the roller shaft so as not to be displaceable relative to the roller shaft in the longitudinal direction, and the guide member is formed to have such a dimension that an outer peripheral surface of the guide member abuts against the inner peripheral surface of the roller shaft without a gap therebetween and an inner peripheral surface of the guide member is in sliding contact with the outer peripheral surface of the small diameter portion without a gap therebetween; and the hydraulic chamber is formed by the inner peripheral surface of the roller shaft, the outer peripheral surface of the small diameter portion, an end surface of the large diameter portion, and an end surface of the guide member.

In the aspect b (with the switching pin and the hydraulic chamber provided inside the roller shaft), the number of hydraulic chambers etc. is not specifically limited, and examples of the number of hydraulic chambers etc. include the following aspects b1 and b2. The aspect b2 is preferable in that only one hydraulic system is required.

[b1] The hydraulic chamber is composed of a coupling hydraulic chamber and a non-coupling hydraulic chamber, and the switching device is configured to displace the switching pin to the coupling position using a hydraulic pressure in the coupling hydraulic chamber, and to displace the switching pin to the non-coupling position using a hydraulic pressure in the non-coupling hydraulic chamber.

[b2] The switching device includes a return spring provided inside the roller shaft, and is configured to displace the switching pin to one of the coupling position and the non-coupling position using the hydraulic pressure in the hydraulic chamber, and to displace the switching pin to the other of the coupling position and the non-coupling position using an urging force of the return spring.

In the aspect b2 (with the return spring), the rocker arm and the switching device are not specifically limited, and examples of the rocker arm and the switching device include the following aspects b2a and b2b. The aspect b2b is preferable in that the rocker arm is well-balanced in the width direction.

[b2a] The roller arm is provided relatively on one side in the width direction, the side arm is provided relatively on the other side in the width direction, and only one switching pin, only one hydraulic chamber, and only one return spring are provided.

[b2b] The roller arm is an inner arm provided on an inner side of the side arm in a width direction, and the side arm is an outer arm provided on an outer side of the roller arm in the width direction; the switching pin includes a first switching pin and a second switching pin arranged side by side with a space therebetween in a longitudinal direction of the roller shaft; the hydraulic chamber includes a first hydraulic chamber and a second hydraulic chamber arranged side by side with a space therebetween in the longitudinal direction of the roller shaft; and the return spring is interposed between the first switching pin and the second switching pin.

The number of valves driven by the rocker arm is not specifically limited, and examples of the number of valves driven by the rocker arm include the following aspects c and d. The aspect d is preferable in that the effect of the present invention that the rocker arm is made compact in the width direction is more distinguished.

[c] One rocker arm drives a plurality of valves.

[d] One rocker arm drives only one valve, and does not drive a plurality of valves.

[First Embodiment]

A variable valve mechanism 1 of an internal combustion engine according to a first embodiment illustrated in FIGS. 1 to 8 is a mechanism that periodically presses a valve 7 in the opening direction to periodically open and close the valve 7. A valve spring 9 that urges the valve 7 in the closing direction is externally fitted with the valve 7. A shim 8 that adjusts the height of the valve 7 is fitted at the stem end of the valve 7. The valve 7 may be an intake valve or an exhaust valve. The variable valve mechanism 1 includes a cam 10, a support member 20, a rocker arm 30, a lost motion spring 50, and a switching device 60.

[Cam 10]

The cam 10 is provided to project from a camshaft 19 that makes one rotation each time an internal combustion engine makes two rotations. The cam 10 includes a base circle 11 having a perfect circle cross-sectional shape, and a nose 12 that projects from the base circle 11. When seen in the graph illustrated in FIG. 8 in which the horizontal axis indicates a rotational angle θ (theta) of the cam 10 and the vertical axis indicates a projection height H from the base circle 11, a profile P of the cam 10 is configured as follows. That is, A is a base circle section, and two uniform velocity sections B2 and B2 in which an inclination P' of the profile P is constant are provided on the inner side of connection sections B1 and B1 provided at both end portions of a nose section B, and a main lift section B3 is further provided on the inner side of the uniform velocity sections B2 and B2. The variable valve mechanism 1 according to the first embodiment does not include a cam that is different from the cam 10 and that abuts against a side arm 41.

[Support Member 20]

The support member 20 is installed to project upward from a cylinder head, and includes a hemispherical portion 23 having a hemispherical shape and provided at the upper end portion of the support member 20 to swingably support the rocker arm 30. The support member 20 is a simple pivot that does not automatically compensate for a tappet clearance C.

[Rocker Arm 30]

The rocker arm 30 includes a roller arm 31 and the side arm 41. The rocker arm 30 is swingably supported by the support member 20. Particularly, the rocker arm 30 includes a hemispherical recessed portion 32 provided in the lower surface of the base end portion of the roller arm 31 to be recessed hemispherically. The rocker arm 30 is swingably supported on the support member 20 with the hemispherical recessed portion 32 swingably placed on the hemispherical portion 23 of the support member 20. The rocker arm 30 drives only one valve 7. Hence, the rocker arm 30 does not drive a plurality of valves.

The roller arm 31 is an inner arm provided on the inner side of the side arm 41 in the width direction, and is driven by the cam 10. The roller arm 31 includes a roller shaft 36 and a roller 38 provided at the distal end portion thereof. The roller shaft 36 is a tubular shaft, and is fixed to a body portion of the roller arm 31 by a fixing member 36*a* such that the roller shaft 36 and the roller arm 31 do not turn relative to each other. The roller 38 is rotatably supported by the roller shaft 36 via bearings 37 and abuts against the cam 10.

The side arm 41 is an outer arm provided on both outer sides of the roller arm 31 in the width direction, and drives the valve 7 when swung. The base end portion of the side arm 41 is coupled to the base end portion of the roller arm 31 via a fulcrum pin 44 such that the side arm 41 and the roller arm 31 swing relative to each other. The distal end portion of the side arm 41 abuts against the valve 7.

Figure 4B:
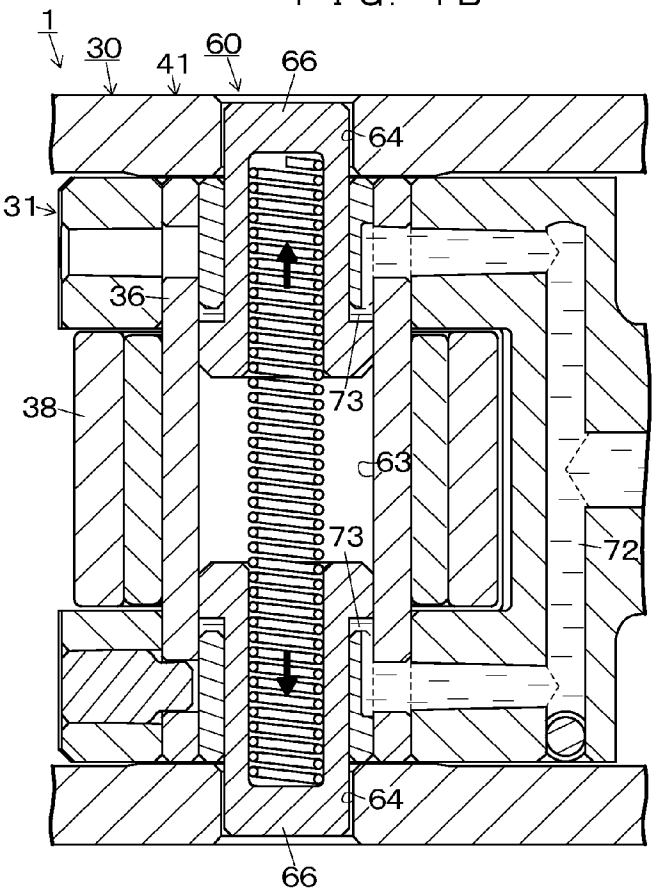
FIG. 4B is a plan sectional view illustrating the variable valve mechanism according to the first embodiment at a coupled time.
Figure 4A:
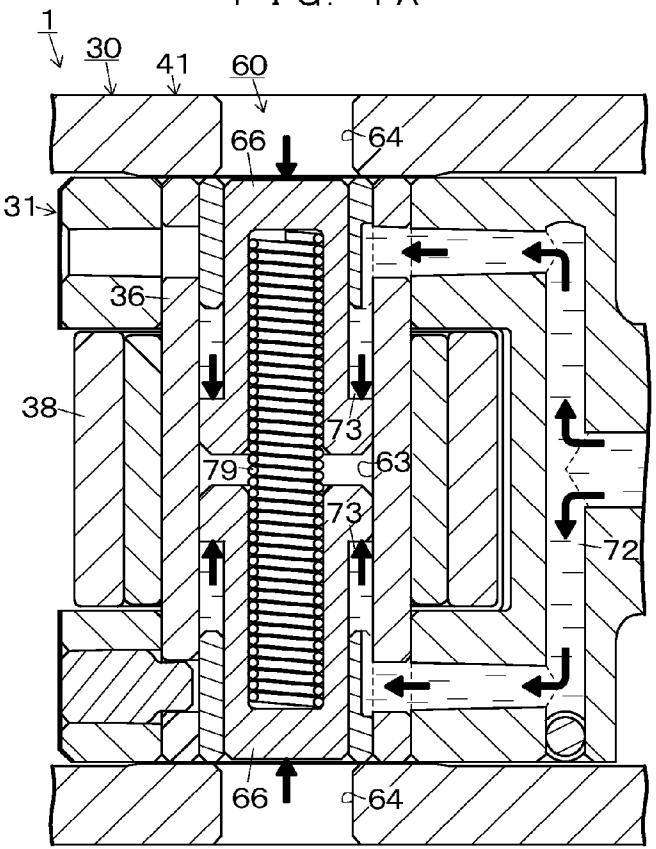
FIG. 4A is a plan sectional view illustrating the variable valve mechanism according to the first embodiment at a non-coupled time.
Figure 5B:
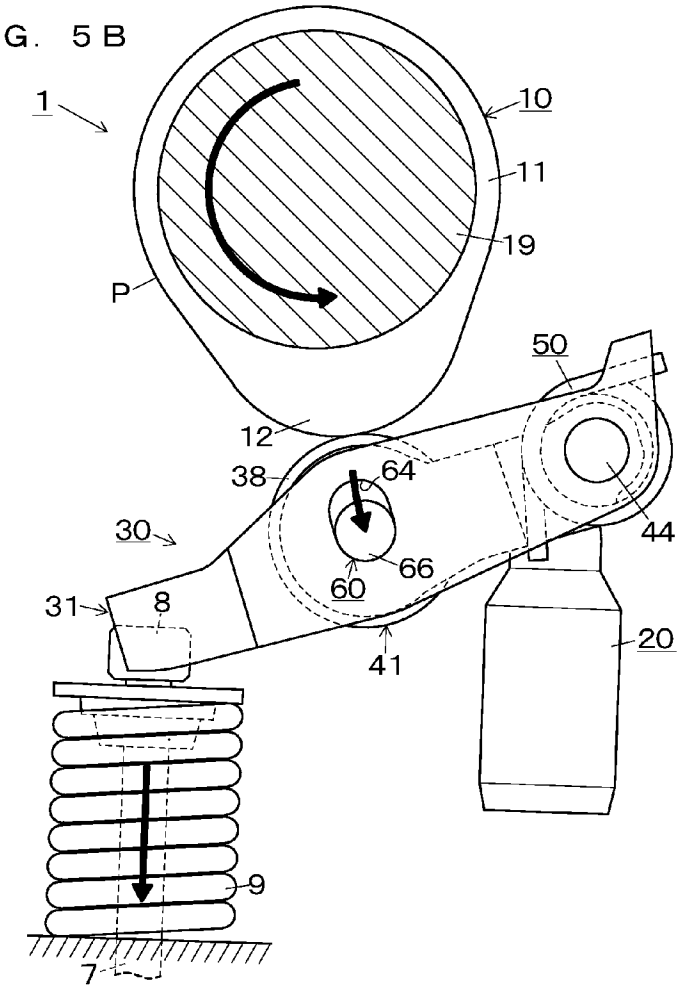
FIG. 5B is a side view illustrating the variable valve mechanism according to the first embodiment at the coupled time (at the nose time)
Figure 5A:
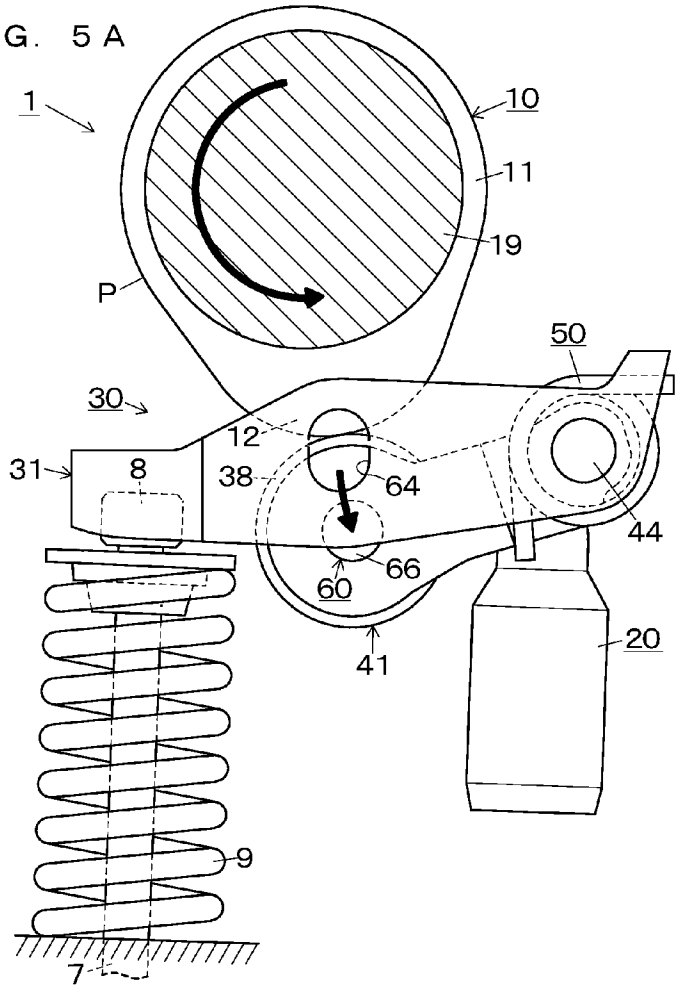
FIG. 5A is a side view illustrating the variable valve mechanism according to the first embodiment at the non-coupled time (at a nose time)

At a non-coupled time when a switching pin 66 of the switching device 60 is disposed at a non-coupling position as illustrated in FIG. 4A, the roller arm 31 is relatively displaced (relatively swung) with respect to the side arm 41 about the fulcrum pin 44 as illustrated in FIG. 5A. Consequently, a resting state in which the valve 7 is not driven is established.

At a coupled time when the switching pin 66 of the switching device 60 is disposed at a coupling position as illustrated in FIG. 4B, on the other hand, the side arm 41 is swung together with the roller arm 31 with the relative displacement (which refers to the relative displacement of the roller arm 31 with respect to the side arm 41; the same applies hereinafter) restricted as illustrated in FIG. 5B. Consequently, a normal state in which the valve 7 is driven is established.

[Lost Motion Spring 50]

At the non-coupled time, the lost motion springs 50, 50 urge the roller arm 31 toward the cam 10, and urge the side arm 41 toward the valve 7 using the reaction force. The lost motion springs 50 are interposed between the inner peripheral surface of recessed portions 35 and 35 provided to be recessed on both sides of a longitudinal-direction intermediate portion of the roller arm 31 and a spring abutment portion 45 provided at the base end portion of the side arm 41.

[Switching Device 60]

The switching device 60 includes a first pin hole 63, second pin holes 64 and 64, the switching pin 66, a guide member 67, oil passages 72 and 72, a hydraulic chamber 73, and a return spring 79. The switching device 60 changes the drive state of the valve 7 between the normal state and the resting state by displacing the switching pins 66 and 66 between the coupling position and the non-coupling position through cooperation between variations in hydraulic pressure in the oil passage 72 and the hydraulic chambers 73 and 73 and the urging force of the return spring 79.

The first pin hole 63 is provided in the roller arm 31, and is specifically a tubular hole in the roller shaft 36. The second pin holes 64 and 64 are provided in the side arm 41, and are specifically provided on both sides of the first pin hole 63 in its longitudinal direction. Each second pin hole 64 is a long hole that is elongated in the relative displacement direction (which refers to the direction of the relative displacement; the same applies hereinafter), that is, elongated in the direction of the circumference about the fulcrum pin 44.

At the non-coupling position, the switching pins 66 and 66 do not extend between the first pin hole 63 and the second pin holes 64 and 64. Particularly, as illustrated in FIG. 4A, the switching pins 66 and 66 are housed in the first pin hole 63. At the coupling position, meanwhile, the switching pins 66 and 66 extend between the first pin hole 63 and the second pin holes 64 and 64. Particularly, as illustrated in FIG. 4B, the distal ends of the switching pins 66 and 66 project into the second pin holes 64 and 64. Hence, the non-coupling position is relatively located on the inner side of the rocker arm 30 in the width direction, and the coupling position is relatively located on the outer side of the rocker arm 30 in the width direction. The switching pins 66 and 66 are displaced in the width direction of the rocker arm 30.

Switching is made to the resting state (non-coupled state) illustrated in FIG. 5A by increasing (turning on) the hydraulic pressure in the hydraulic chambers 73 and 73 to displace the switching pins 66 and 66 to the non-coupling position using the hydraulic pressure as illustrated in FIG. 4A. Meanwhile, switching is made to the normal state (coupled state) illustrated in FIG. 5B by reducing (turning off) the hydraulic pressure in the hydraulic chambers 73 and 73 to displace the switching pins 66 and 66 to the coupling position using the urging force of the return spring 79 as illustrated in FIG. 4B.

Figure 6B:
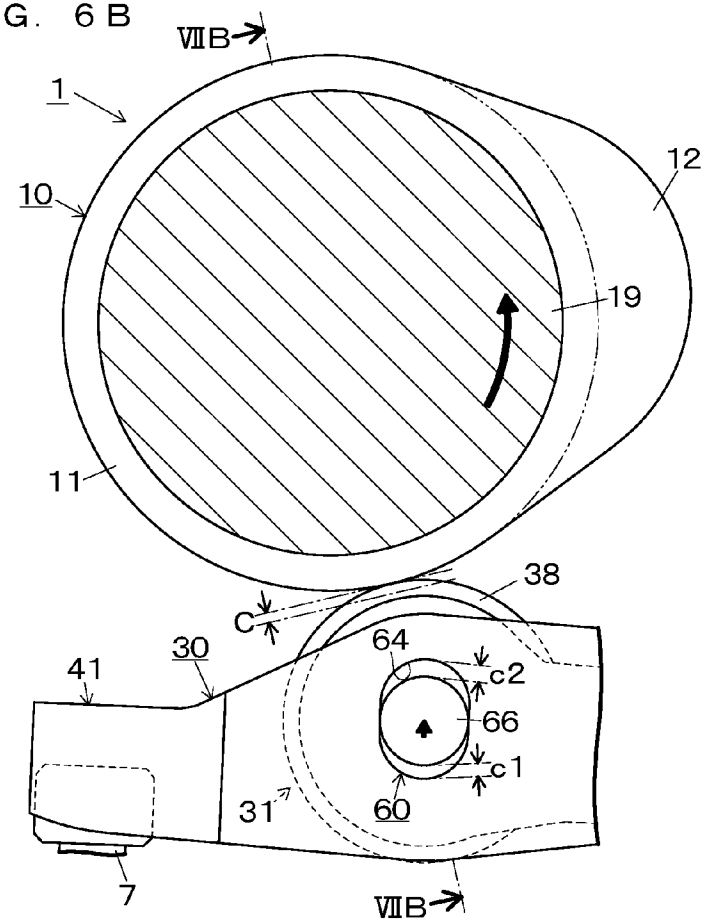
FIG. 6B is a side view illustrating the variable valve mechanism according to the first embodiment at the coupled time immediately after the transition.
Figure 6A:
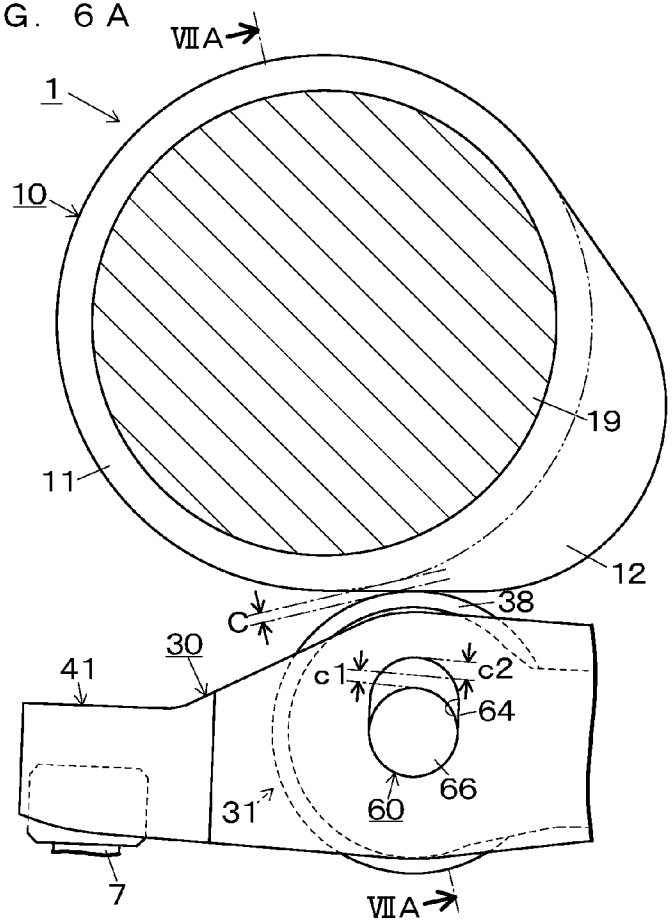
FIG. 6A is a side view illustrating the variable valve mechanism according to the first embodiment at the coupled time immediately before a transition from the nose time to a base circle time.
Figure 7B:
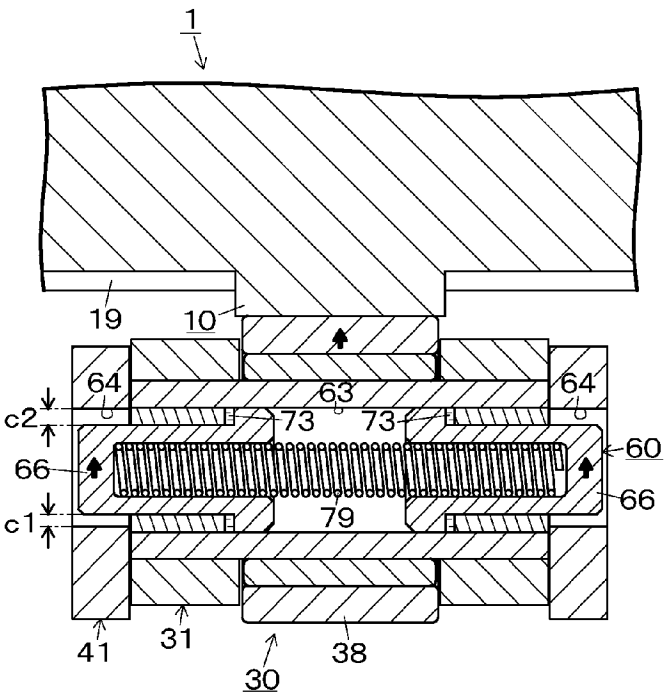
FIG. 7B is a front sectional view (a VIIB-VIIB sectional view illustrated in FIG. 6B) illustrating the variable valve mechanism according to the first embodiment at the coupled time immediately after the transition.
Figure 7A:
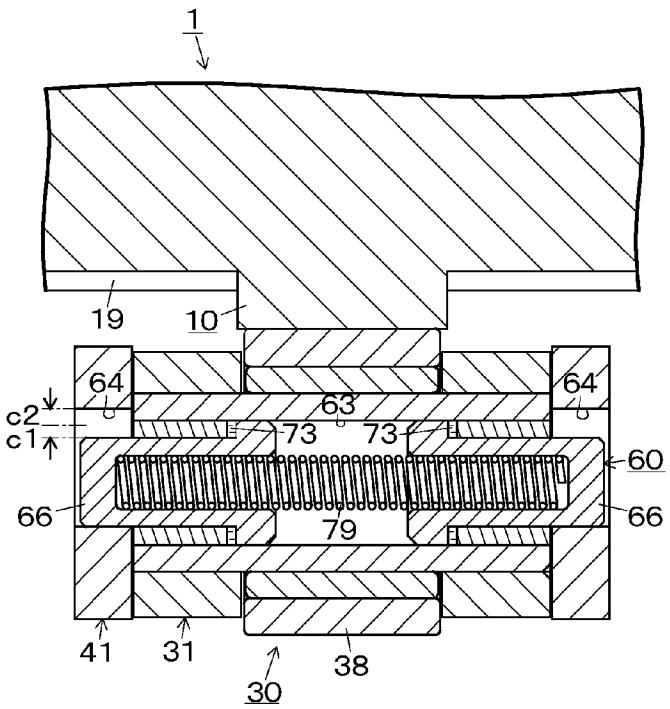
FIG. 7A is a front sectional view (a VIIA-VIIA sectional view illustrated in FIG. 6A) illustrating the variable valve mechanism according to the first embodiment at the coupled time immediately before a transition from the nose time to the base circle time.

At the coupled time (normal state), as illustrated in FIGS. 6A and 6B, a displacement clearance c1 in the relative displacement direction is formed between the inner peripheral surface of each second pin hole 64 and the outer peripheral surface of the switching pin 66 to permit the relative displacement in the range of the displacement clearance c1. Therefore, the roller arm 31 is urged toward the cam 10 by the lost motion spring 50 also at the coupled time. Therefore, the tappet clearance C is not formed between the base circle 11 and the roller arm 31 as illustrated in FIG. 6B also at a base circle time (which refers to a time when the base circle 11 acts on the roller arm 31; the same applies hereinafter) at the coupled time. The symbol "C" used in FIGS. 6A and 6B indicates the tappet clearance C which would originally be formed and which is not formed in the first embodiment.

Figure 8:
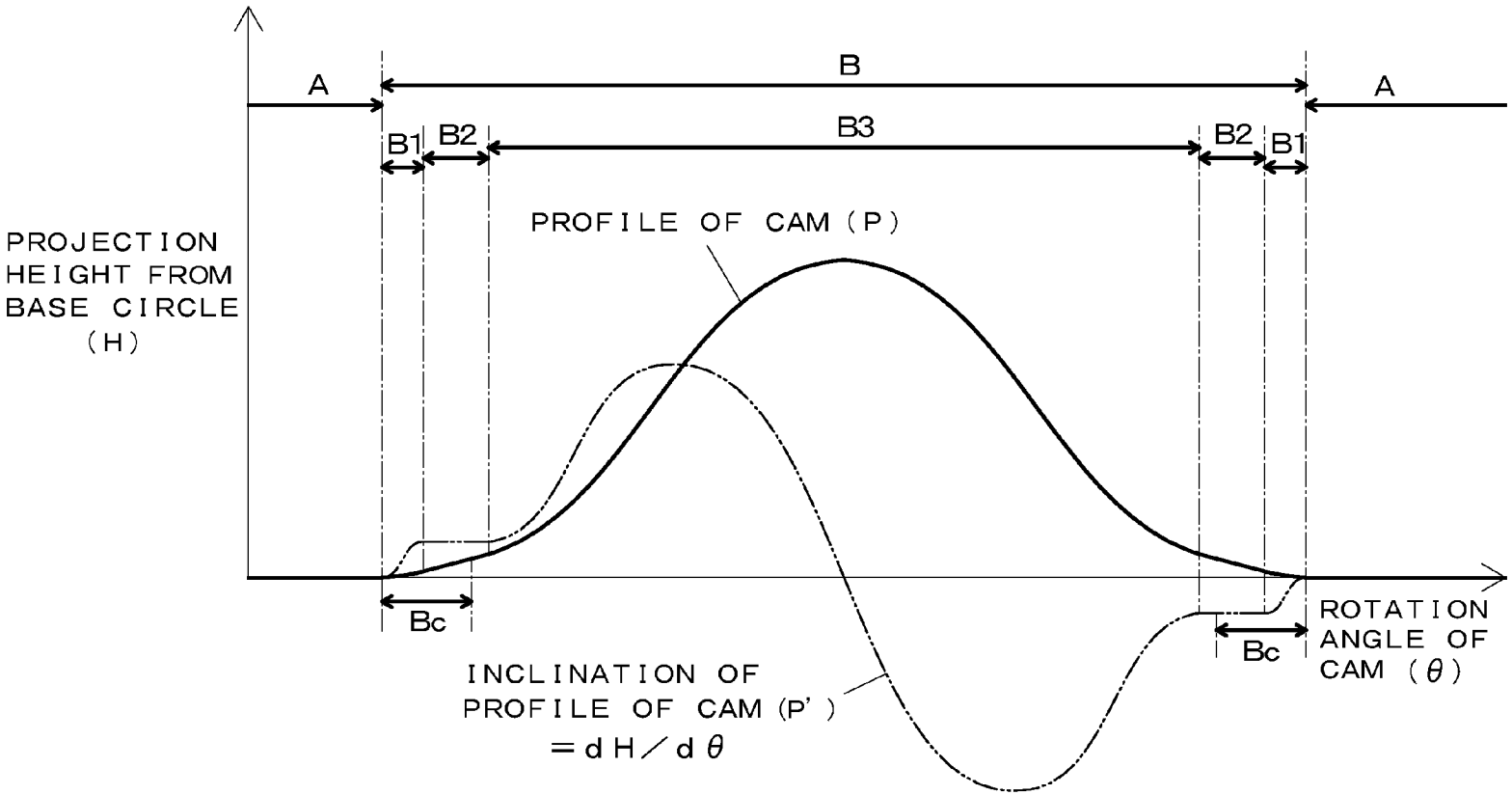
FIG. 8 is a graph illustrating the profile of a cam of the variable valve mechanism according to the first embodiment.

Particularly, the displacement clearance c1 is formed to have such a size that permits the relative displacement only in ranges Bc and Bc, which are included in both the connection sections B1 and B1 and the uniform velocity sections B2 and B2, and that does not permit the relative displacement in the main lift section B3 at the coupled time as illustrated in FIG. 8. The following describes the base circle time at the coupled time. That is, as illustrated in FIG. 6B, the displacement clearance c1 is formed between one end of the inner peripheral surface of each second pin hole 64 in the relative displacement direction and the outer peripheral surface of the switching pin 66. In addition, an adjustment clearance c2 that does not permit the relative displacement is formed between the other end of the inner peripheral surface in the relative displacement direction and the outer peripheral surface of the switching pin 66. The size of the displacement clearance c1 is about 0.15 mm. The size of the adjustment clearance c2 is about 0.75 mm.

The switching pins 66 and 66 are provided on the axis of the roller 38, and are specifically provided inside the roller shaft 36. The switching pins 66 and 66 are composed of a first switching pin 66 and a second switching pin 66 arranged side by side with a space therebetween in the longitudinal direction of the roller shaft 36. Each switching pin 66 includes a large diameter portion 66*a* and a small diameter portion 66*b* arranged side by side in the longitudinal direction of the roller shaft 36. Particularly, each switching pin 66 includes the large diameter portion 66*a* provided on the inner side in the width direction of the rocker arm 30, and the small diameter portion 66*b* provided on the outer side in the width direction. The large diameter portion 66*a* is formed to have such a dimension that the outer peripheral surface of the large diameter portion 66*a* is in sliding contact with the inner peripheral surface of the roller shaft 36 without a gap therebetween. Meanwhile, the small diameter portion 66*b* is formed to have such a dimension that there is a gap between the outer peripheral surface of the small diameter portion 66*b* and the inner peripheral surface of the roller shaft 36.

The guide members 67 and 67 are tubular members attached inside the roller shaft 36 so as to be undisplaceable in the longitudinal direction of the roller shaft 36. Each guide member 67 is formed to have such a dimension that the outer peripheral surface of the guide member 67 abuts against the inner peripheral surface of the roller shaft 36 without a gap therebetween and the inner peripheral surface of the guide member 67 is in sliding contact with the outer peripheral surface of the small diameter portion 66*b* without a gap therebetween.

The oil passage 72 extends to the hydraulic chambers 73 and 73 by way of the support member 20 and the roller arm 31. The hydraulic chambers 73 and 73 are provided inside the roller arm 31, and are specifically provided inside the roller shaft 36. Particularly, the hydraulic chambers 73 and 73 are composed of a first hydraulic chamber 73 and a second hydraulic chamber 73 arranged side by side with a space therebetween in the longitudinal direction of the roller shaft 36. Each hydraulic chamber 73 is formed by the inner peripheral surface of the roller shaft 36, the outer peripheral surface of the small diameter portion 66*b*, the end surface of the large diameter portion 66*a*, and the end surface of the guide member 67. The return spring 79 is interposed between the first switching pin 66 and the second switching pin 66 inside the roller shaft 36.

According to the first embodiment, the following effects A to G can be obtained.

[A] The tappet clearance C can be eliminated using a simple structure that is different from a lash adjuster or the like by providing the displacement clearance c1.

[B] The absence of the tappet clearance C eliminates anxiety that the rocker arm 30 may be lifted from the support member 20 by the switching hydraulic pressure applied to the oil passage 72 by an amount corresponding to the tappet clearance C to reduce the switching hydraulic pressure. Hence, it is possible to secure the stability of the switching hydraulic pressure by securing the sealability of the oil passage 72 at the boundary portion between the support member 20 and the rocker arm 30.

[C] The lost motion spring 50 urges the side arm 41 toward the valve 7 using the reaction force generated when the roller arm 31 is urged toward the cam 10 at the non-coupled time. Thus, there is no anxiety that the side arm 41 may flutter at the non-coupled time even without the different cam described above.

[D] The second pin holes 64 and 64 permit the relative displacement only in the ranges Bc and Bc, which are included in both the connection sections B1 and B1 and the uniform velocity sections B2 and B2, and do not permit the relative displacement in the main lift section B3 at the coupled time. Thus, there is no anxiety that the stroke of the relative displacement at the coupled time may be excessively large. Therefore, there is no anxiety that the valve lift amount maybe smaller than necessary, or no anxiety that an impact at the end point of the relative displacement at the coupled time may be excessively large.

[E] At the base circle time at the coupled time, the displacement clearance c1 and the adjustment clearance c2 are formed on both sides of the switching pin 66 in the relative displacement direction. Thus, the proportions of the displacement clearance c1 and the adjustment clearance c2 can be changed by just replacing the shim 8 fitted at the stem end of the valve 7 with a shim with a different thickness. Therefore, the size of the displacement clearance c1 (the size of the tappet clearance C which would originally be formed) can be adjusted easily. With formation of the adjustment clearance c2, further, the urging force of the lost motion spring 50 which urges the roller arm 31 toward the base circle 11 is not lost but secured even at the base circle time at the coupled time. Thus, the roller arm 31 can be reliably caused to abut against the base circle 11.

[F] The switching pins 66 and 66 are provided on the axis of the roller 38 which is driven by the cam 10. Therefore, the relative displacement at the non-coupled time is simplified compared to a case where the switching pins are provided near the center of swing. Therefore, the structure of the rocker arm 30 is simplified.

[G] The presence of the roller 38 allows the hydraulic chambers 73 and 73 to be provided inside the roller arm 31 which is wide. Thus, the rocker arm 30 is unlikely to be wide compared to a case where the hydraulic chambers are provided inside the side arm 41. Therefore, the rocker arm 30 can be made compact in the width direction. Therefore, the present invention can be implemented even in an aspect in which only one valve 7 is driven by one rocker arm 30 as in the embodiment.

[Second Embodiment]

Figure 9:
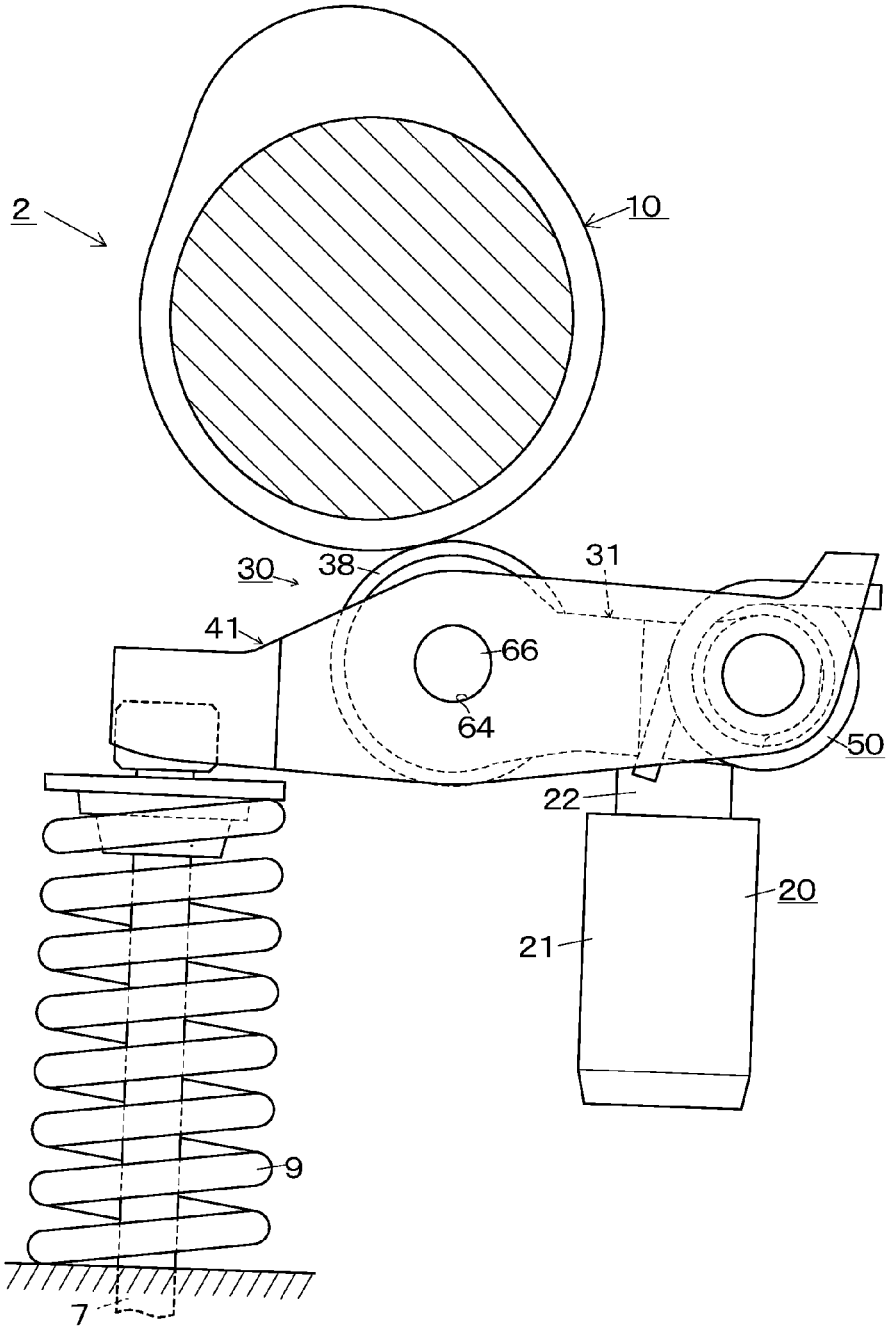
FIG. 9 is a side view illustrating the variable valve mechanism according to a second embodiment.
Figure 10:
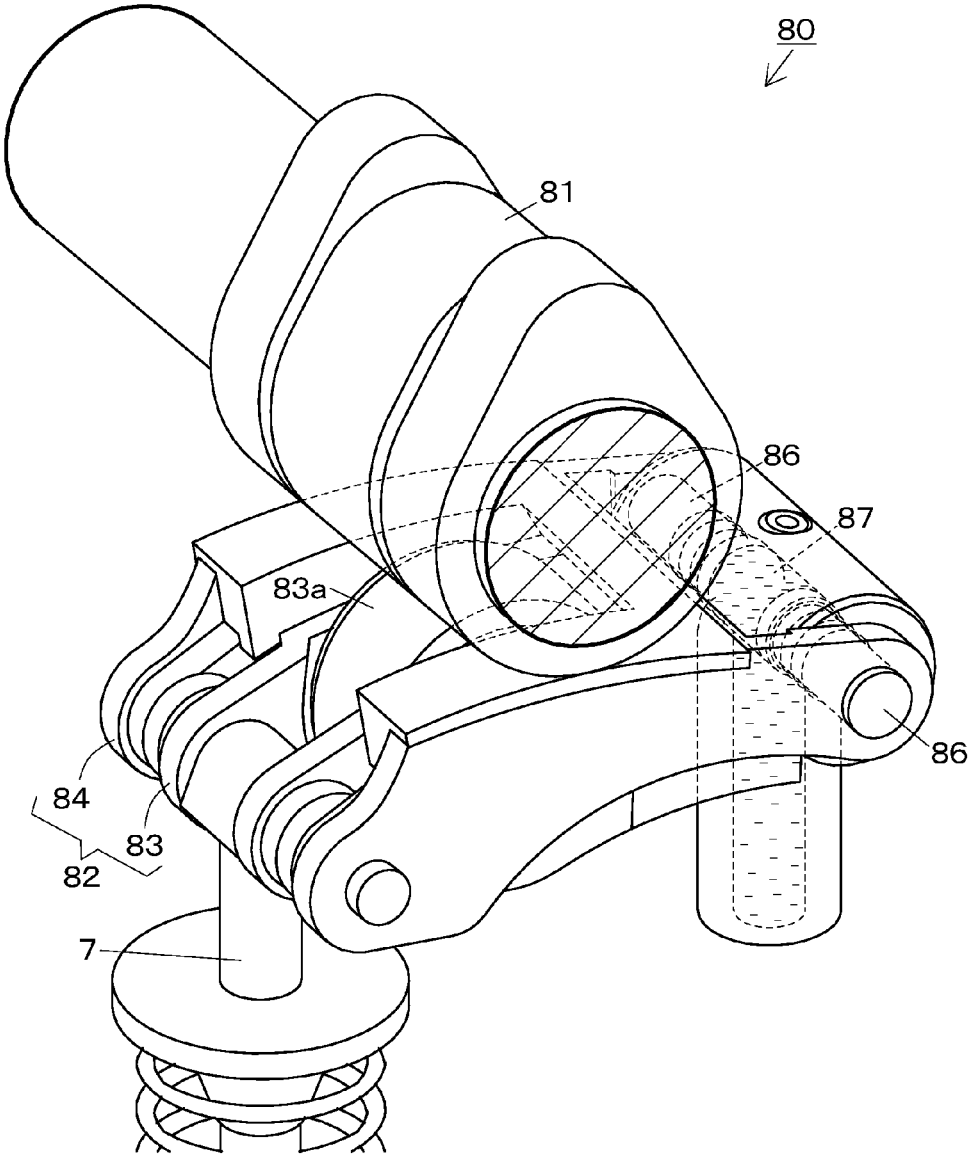
FIG. 10 RELATED ART
FIG. 10 is a perspective view illustrating a variable valve mechanism according to the first related art.
Figure 11:
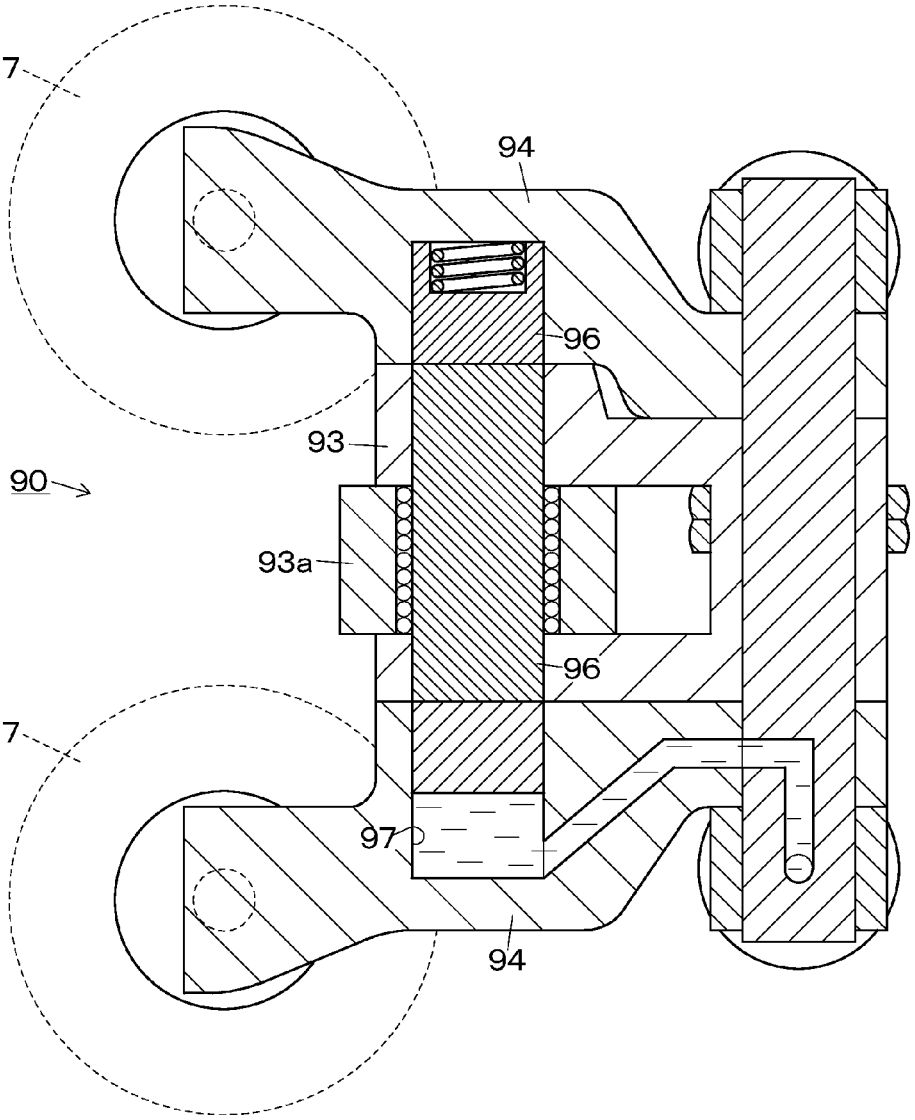
FIG. 11 RELATED ART
FIG. 11 is a plan sectional view illustrating a variable valve mechanism according to the second related art.

A variable valve mechanism 2 of an internal combustion engine according to a second embodiment illustrated in FIG. 9 is different from that according to the first embodiment in the following points, and otherwise similar thereto. That is, each second pin hole 64 is formed to have such a dimension that the inner peripheral surface of the second pin hole 64 abuts against the outer peripheral surface of the switching pin 66 without a gap therebetween. Hence, the displacement clearance c1 and the adjustment clearance c2 are not formed at the coupled time. At the coupled time, the return spring 79 urges the roller arm 31 toward the side arm 41 via the switching pin 66.

The support member 20 is a hydraulic lash adjuster that automatically compensates for a tappet clearance formed between the cam 10 and the roller 38 exactly. The support member 20 (lash adjuster) includes a bottomed tubular body 21 that opens upward and a plunger 22 having a lower portion inserted into the body 21. The hemispherical portion 23 which swingably supports the rocker arm 30 is provided at the upper end of the plunger 22.

Also according to the second embodiment, the effects C, F, and G described above can be obtained.

The present invention is not limited to the configurations according to the embodiments described above, and may be implemented as modified as appropriate without departing from the scope and spirit of the invention as in the following modifications, for example.

[First Modification]

The side arm 41 may be driven by a low-lift cam with a small lift amount or action angle compared to the cam 10. In this case, a low-lift state in which the valve 7 is driven with a small lift amount or action angle compared to the normal state, rather than the resting state, is established at the non-coupled time.

[Second Modification]

Two valves 7 and 7 may be driven by one rocker arm 30.

REFERENCE SIGNS LIST

1 Variable valve mechanism (first embodiment)
2 Variable valve mechanism (second embodiment)
7 Valve
10 Cam
30 Rocker arm
31 Roller arm
36 Roller shaft
38 Roller
41 Side arm
50 50 Lost motion spring
60 Switching device
66 Switching pin
**66*a*** Large diameter portion
**66*b*** Small diameter portion
67 Guide member
72 Oil passage
73 Hydraulic chamber
79 Return spring

The invention claimed is:

1. A variable valve mechanism of an internal combustion engine, the variable valve mechanism comprising:

a rocker arm that includes a roller arm including a roller that rotatably abuts against a cam and a side arm provided at a side of the roller arm, and that drives a valve; and a switching device that includes a switching pin and a hydraulic chamber provided inside the rocker arm, and that switches a drive state of the valve by displacing the switching pin between a coupling position at which the switching pin extends between the roller arm and the side arm and a non-coupling position at which the switching pin does not extend between the roller arm and the side arm based on variations in hydraulic pressure in the hydraulic chamber, wherein the roller arm includes an inner arm provided on an inner side of the side arm in a width direction, wherein the side arm includes an outer arm provided on both outer sides of the roller arm in the width direction, and the side arm does not include a roller, wherein the switching pin is provided on an axis of the roller, and the hydraulic chamber is provided inside the roller arm which includes the inner arm.

2. The variable valve mechanism of an internal combustion engine according to claim 1, wherein the roller arm includes a roller shaft that supports the roller, and wherein the switching pin and the hydraulic chamber are provided inside the roller shaft.

3. The variable valve mechanism of an internal combustion engine according to claim 2, wherein the roller shaft includes a tubular shaft, wherein the switching pin includes a large diameter portion and a small diameter portion arranged side by side in a longitudinal direction of the roller shaft, the large diameter portion is formed to have such a dimension that an outer peripheral surface of the large diameter portion is in sliding contact with an inner peripheral surface of the roller shaft without a gap therebetween, and the small diameter portion is formed to have such a dimension that there is a gap between an outer peripheral surface of the small diameter portion and the inner peripheral surface of the roller shaft, wherein a tubular guide member is attached inside the roller shaft so as not to be displaceable relative to the roller shaft in the longitudinal direction, and the guide member is formed to have such a dimension that an outer peripheral surface of the guide member abuts against the inner peripheral surface of the roller shaft without a gap therebetween and an inner peripheral surface of the guide member is in sliding contact with the outer peripheral surface of the small diameter portion without a gap therebetween, and wherein the hydraulic chamber is formed by the inner peripheral surface of the roller shaft, the outer peripheral surface of the small diameter portion, an end surface of the large diameter portion, and an end surface of the guide member.

4. The variable valve mechanism of an internal combustion engine according to claim 2, wherein the switching device includes a return spring provided inside the roller shaft, and is configured to displace the switching pin to one of the coupling position and the non-coupling position using the hydraulic pressure in the hydraulic chamber, and to displace the switching pin to an other of the coupling position and the non-coupling position using an urging force of the return spring.

5. The variable valve mechanism of an internal combustion engine according to claim 4, wherein the switching pin includes a first switching pin and a second switching pin arranged side by side with a space therebetween in a longitudinal direction of the roller shaft, wherein the hydraulic chamber includes a first hydraulic chamber and a second hydraulic chamber arranged side by side with a space therebetween in the longitudinal direction of the roller shaft, and wherein the return spring is interposed between the first switching pin and the second switching pin.

6. The variable valve mechanism of an internal combustion engine according to claim 1, wherein one rocker arm drives only one valve, and does not drive a plurality of valves.

7. The variable valve mechanism of an internal combustion engine according to claim 1, further comprising:

a lost motion spring that urges the roller arm toward the cam and urges the side arm toward the valve at a non-coupled time when the switching pin is disposed at the non-coupling position.

8. The variable valve mechanism of an internal combustion engine according to claim 1, wherein the roller arm includes a roller shaft that supports the roller, and wherein the switching pin includes a large diameter portion and a small diameter portion arranged side by side in a longitudinal direction of the roller shaft, the large diameter portion having a larger diameter than the small diameter portion.

9. The variable valve mechanism of an internal combustion engine according to claim 8, wherein the large diameter portion is formed to have such a dimension that an outer peripheral surface of the large diameter portion is in sliding contact with an inner peripheral surface of the roller shaft without a gap therebetween.

10. The variable valve mechanism of an internal combustion engine according to claim 9, wherein the small diameter portion is formed to have such a dimension that there is a gap between an outer peripheral surface of the small diameter portion and the inner peripheral surface of the roller shaft.

11. The variable valve mechanism of an internal combustion engine according to claim 10, wherein a tubular guide member is attached inside the roller shaft so as not to be displaceable relative to the roller shaft in the longitudinal direction.

12. The variable valve mechanism of an internal combustion engine according to claim 11, wherein the guide member is formed to have such a dimension that an outer peripheral surface of the guide member abuts against the inner peripheral surface of the roller shaft without a gap therebetween and an inner peripheral surface of the guide member is in sliding contact with the outer peripheral surface of the small diameter portion without a gap therebetween.

13. The variable valve mechanism of an internal combustion engine according to claim 12, wherein the hydraulic chamber is formed by the inner peripheral surface of the roller shaft, the outer peripheral surface of the small diameter portion, an end surface of the large diameter portion, and an end surface of the guide member.

14. The variable valve mechanism of an internal combustion engine according to claim 1, wherein the roller arm includes a roller shaft that supports the roller, and wherein the switching pin includes a first switching pin and a second switching pin arranged side by side with a space therebetween in a longitudinal direction of the roller shaft.

15. The variable valve mechanism of an internal combustion engine according to claim 14, wherein the hydraulic chamber includes a first hydraulic chamber and a second hydraulic chamber arranged side by side with a space therebetween in the longitudinal direction of the roller shaft.

16. The variable valve mechanism of an internal combustion engine according to claim 15, wherein a return spring of the roller shaft is interposed between the first switching pin and the second switching pin.

17. The variable valve mechanism of an internal combustion engine according to claim 14, wherein a return spring of the roller shaft is interposed between the first switching pin and the second switching pin.

* * * * *